US010370898B2

(12) United States Patent
Short

(10) Patent No.: US 10,370,898 B2
(45) **Date of Patent: *Aug. 6, 2019**

(54) TETHER SYSTEM FOR A SAFETY LINE

(71) Applicant: Latchways PLC, Devizes (GB)

(72) Inventor: Richard Short, Keynsham (GB)

(73) Assignee: Latchways PLC, Devizes (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/708,583

(22) Filed: Sep. 19, 2017

(65) Prior Publication Data

US 2018/0002983 A1 Jan. 4, 2018

Related U.S. Application Data

(63) Continuation of application No. 14/777,927, filed as application No. PCT/GB2014/050841 on Mar. 17, 2014, now Pat. No. 9,784,034.

(30) Foreign Application Priority Data

Mar. 18, 2013 (GB) ..... 1304933.3

(51) Int. Cl.
*A62B 35/00* (2006.01)
*E06C 7/18* (2006.01)

(52) U.S. Cl.
CPC ..... *E06C 7/186* (2013.01); *A62B 35/005* (2013.01); *A62B 35/0075* (2013.01); *A62B 35/0093* (2013.01)

(58) Field of Classification Search
CPC ..... H02G 7/08; A62B 35/005; A62B 1/00; A62B 35/04; A62B 35/0043; A62B 35/0068; A62B 35/0093; A62B 35/0056; A62B 35/0005; E06C 7/18; E06C 7/186; E06C 5/36
USPC ..... 182/5, 8
See application file for complete search history.

(56) References Cited

U.S. PATENT DOCUMENTS 323,092 A * 7/1885 Werner ..... A62B 1/00 182/42
453,134 A * 5/1891 Tallas et al. ..... A62B 1/14 182/5
471,145 A * 3/1892 Schneider ..... A62B 1/00 182/42

(Continued)

FOREIGN PATENT DOCUMENTS

DE 820169 C 11/1951
WO WO2004103473 A1 12/2004

(Continued)

OTHER PUBLICATIONS

Communication pursuant to Article 94(3) EPC of application No. 14 711 603.2-1113 dated Jan. 10, 2019.

*Primary Examiner* — Daniel P Cahn
(74) *Attorney, Agent, or Firm* — Gordon & Jacobson, P.C.

(57) ABSTRACT

A tether system for a safety line has an elongate guide track and stay elements arranged to move along the guide track and be carried at spaced positions along the length of a tether line. The system is typically employed in a fall arrest or protection system mounted to a structure, having an ascent/descent ladder fixed to the structure, the system including a self-retracting safety line device including a safety line, mounted at height.

15 Claims, 3 Drawing Sheets

(56) References Cited

U.S. PATENT DOCUMENTS 715,330 A * 12/1902 Zimmer ..... A62B 1/00 182/42
861,707 A * 7/1907 Cain ..... A62B 1/00 182/241
955,243 A * 4/1910 Witt ..... A62B 1/00 182/42
1,351,734 A * 9/1920 Barrington ..... A62B 1/06 182/5
1,916,208 A * 7/1933 Diou ..... E06C 7/187 182/8
2,166,809 A * 7/1939 Frankel ..... A62B 35/00 182/6
3,459,276 A * 8/1969 Fuse ..... A62B 1/06 182/72
3,598,200 A * 8/1971 Thompson ..... E06C 7/186 182/106
3,759,346 A * 9/1973 Brda ..... A62B 1/06 182/7
3,869,021 A * 3/1975 Sutherland ..... A62B 35/0018 182/135
3,908,791 A * 9/1975 Kleine ..... A62B 1/14 182/8
4,003,550 A * 1/1977 Brodin ..... A62B 1/10 182/192
4,071,124 A 1/1978 Price
4,538,704 A * 9/1985 Forrest ..... A62B 1/02 182/10
4,546,855 A * 10/1985 Lyons ..... E06C 9/02 182/106
4,550,801 A * 11/1985 Forrest ..... A62B 1/06 182/191
4,553,636 A * 11/1985 Itoh ..... A62B 1/02 182/142
4,598,792 A * 7/1986 Lew ..... A62B 1/00 182/42
4,664,224 A * 5/1987 Chen ..... E06C 1/56 182/106
4,703,831 A * 11/1987 Forrest ..... A62B 1/06 182/3
4,709,783 A * 12/1987 Tomioka ..... A62B 1/00 182/198
4,867,276 A 9/1989 Tamietti
4,941,549 A * 7/1990 Da-Tan ..... A62B 1/10 182/234
5,056,619 A * 10/1991 Darnell ..... A62B 1/06 182/191
5,186,275 A * 2/1993 Bajin ..... A62B 1/06 182/231
5,219,039 A * 6/1993 Bell ..... A62B 35/04 182/3
5,265,696 A * 11/1993 Casebolt ..... A62B 1/14 182/192
5,964,316 A * 10/1999 Roy ..... A62B 35/0068 182/3
5,979,599 A * 11/1999 Noles ..... A62B 35/0087 182/3
6,092,623 A * 7/2000 Collavino ..... A62B 35/0056 182/3
6,298,945 B1 * 10/2001 Anders ..... A62C 99/00 169/70
6,390,235 B1 * 5/2002 Tsay ..... A62B 1/00 182/42
6,401,863 B1 * 6/2002 Kirkland ..... B66D 3/20 182/142
6,837,337 B2 1/2005 Thomas et al.
6,877,794 B2 * 4/2005 Bush, Sr. ..... B60J 5/062 296/183.1
6,886,661 B1 * 5/2005 Battenberg ..... E06C 9/08 182/77
6,892,857 B2 * 5/2005 Baker ..... A62B 1/20 182/138
7,425,030 B2 * 9/2008 Warner ..... B60P 7/0876 296/100.11
8,413,764 B1 * 4/2013 Cohen ..... E06C 7/18 182/62.5
8,875,839 B1 * 11/2014 Licea ..... A62B 35/005 182/5
9,272,167 B2 * 3/2016 Smit ..... A62B 35/0043
9,731,640 B1 * 8/2017 Meacham ..... B60P 1/00
9,784,034 B2 10/2017 Short
2002/0014370 A1 2/2002 Casebolt et al.
2002/0046902 A1 * 4/2002 Choate ..... A62B 35/0056 182/3
2004/0055818 A1 * 3/2004 Fulton ..... A62B 35/0056 182/3
2004/0055824 A1 * 3/2004 Karnes ..... A62B 1/10 182/234
2005/0161284 A1 * 7/2005 Casebolt ..... E04G 21/3261 182/3
2005/0161285 A1 * 7/2005 Blackford ..... A62B 1/04 182/36
2006/0289233 A1 * 12/2006 Flaherty ..... A62B 35/0068 182/45
2007/0107984 A1 * 5/2007 Bissett ..... A62B 1/20 182/3
2008/0142298 A1 * 6/2008 Blasek ..... E06C 7/12 182/101
2010/0032236 A1 * 2/2010 Morris ..... A62B 35/0056 182/112
2010/0219016 A1 * 9/2010 Meillet ..... E06C 7/186 182/8
2011/0001100 A1 * 1/2011 Ogawa ..... G02B 6/483 254/134.3 R
2013/0068559 A1 * 3/2013 Grado ..... E06C 7/16 182/102
2014/0262616 A1 * 9/2014 Cullum ..... E06C 7/188 182/107
2014/0291071 A1 * 10/2014 Conde, Jr. ..... A62B 1/00 182/70
2015/0075907 A1 * 3/2015 Moss ..... E06C 7/48 182/129
2015/0252619 A1 * 9/2015 Kramer ..... E06C 5/36 182/3

FOREIGN PATENT DOCUMENTS

WO WO2007128307 A1 11/2007
WO WO 2012164278 * 5/2011 ..... A62B 35/005
WO WO20120164278 A1 12/2012

* cited by examiner

TETHER SYSTEM FOR A SAFETY LINE

CROSS-REFERENCE TO RELATED APPLICATIONS

This application is a continuation of U.S. patent application Ser. No. 14/777,927, filed on Sep. 17, 2015, which is the National Stage of International Patent Application No. PCT/GB2014/050841, filed on Mar. 17, 2014, which claims priority from British Patent Application No. GB 1304933.3, filed on Mar. 18, 2013, all of which are hereby incorporated by reference herein in their entireties.

BACKGROUND

1. Field

The present invention relates to tether system for a safety line, particularly for a fall arrest system.

2. State of the Art

Prior art safety systems are known in which tall structures are fitted with a safety systems such as self retracting lifelines (SRLs) anchored at an elevated position on the structure. For example towers, masts, or wind turbine structures may be fitted with a SRL anchored at an elevated position toward the top of the structure. A personnel ladder is typically secured to the structure to enable personnel access to the top of the structure for maintenance or other purposes. The person secures themselves to the SRL before climbing the ladder and following ascent and subsequent descent of the ladder the person releases the SRL.

There is an issue that the SRL, when not in use, as the line in the retracted position is wound onto the SRL drum in the housing of the SRL. This ensures that the safety line is not exposed when not in use. However it means that when the person is at the foot of the structure before ascending the ladder, the attachment point at the end of the line is positioned high up at the SRL.

There are various solutions to this problem. In a first prior art system the attachment point (karabiner) at the end of the safety line is secured to an endless tether line loop mounted about a pair of pulleys one positioned at the foot of the structure and one high up toward the top of the structure. The tether line loop can be pulled by a person positioned at the foot of the structure and as the tether line moves along its path the end of the safety line connected to the tether line is pulled downwardly in so doing paying out the safety line from the SRL. When the end of the safety line is pulled down all the way to the foot of the structure the person can secure the safety line to their personal harness for ascent of the structure. Following descent, the person can unclip the safety line from the harness and ensure that it is re-secured to the tether line. The person can then pull the tether line in the reverse direction to allow the safety line to retract back into the SRL.

In the hostile maritime environment the pulley wheels and line arrangement can become corroded and seized and therefore inoperable. Also there are problems in tensioning such systems in conditions of strong tides and powerful waves.

An alternative solution is shown in for example WO2007/128307. In this arrangement an auxiliary line is connected to the end of the safety line. When the safety line is fully retracted into the SRL housing, the length of the auxiliary line extends downwardly by a distance equivalent to the height of the structure. The user at the foot of the structure pulls on the auxiliary line in order to pull the SRL attachment karabiner downwardly paying out the safety line for attachment to the user. A disadvantage is that the auxiliary line may become tangled making subsequent automatic retraction of the safety line into the SRL difficult. If the safety line is not fully retracted following use the internal parts of the SRL may be left open to corrosion as would be the length of safety line remaining exposed.

SUMMARY

An improved tether and safety system has been devised which provides advantages over known prior art systems.

According to the present invention, there is provided a tether system for a safety line, the tether system comprising:

an elongate guide track;

a plurality of stay elements arranged to move along the guide track and be carried at spaced positions along the length of a tether line.

It is preferred that the system includes a tether line for connection to the safety line.

The elongate guide track is preferably provided with bracket fixing means for mounting the guide track, proximate opposed ends, to a structure.

In certain embodiments, it may be preferred that the elongate track is mounted in tension. In such an embodiment, it may be preferred that the system includes a tensioning arrangement for imparting, or varying, tension into the elongate guide track.

In certain embodiments the guide track may comprise a flexible elongate line such as a length of webbing, ribbon, cable or rope.

It is preferred that the guide track is a fixed position guide track. As opposed to a moving pulley system, for example.

It is preferred that the stay elements include a formation arranged to permit sliding travel with respect to the track element whilst inhibiting parting or separation of the stay elements and guide track.

The stay elements may include a channel or slot formation arranged to permit sliding travel with respect to the track element.

It is preferred that the stay elements are provided with means for securing to the tether line. For example the stay elements may be provided with holes through which the tether line extends for securing. The holes may be dimensioned such that the stays do not slide along the tether line, but rather are secured in position and move with the tether line.

Typically the elongate guide track is oriented substantially vertically.

Typically, the elongate guide track is mounted to or adjacent to a ladder structure.

According to a related aspect, the invention provides a fall arrest or protection system mounted to a structure, having an ascent/descent ladder fixed to the structure, the system including a self-retracting safety line device including a safety line, mounted at height; an elongate guide track extending along at least a part of the length of the ladder; a plurality of stay elements arranged to move along the guide track and be carried at spaced positions along the length of a tether line connected to the safety line.

The invention will now be further described, by way of example, with reference to the accompanying drawings.

DETAILED DESCRIPTION

Figure 1:
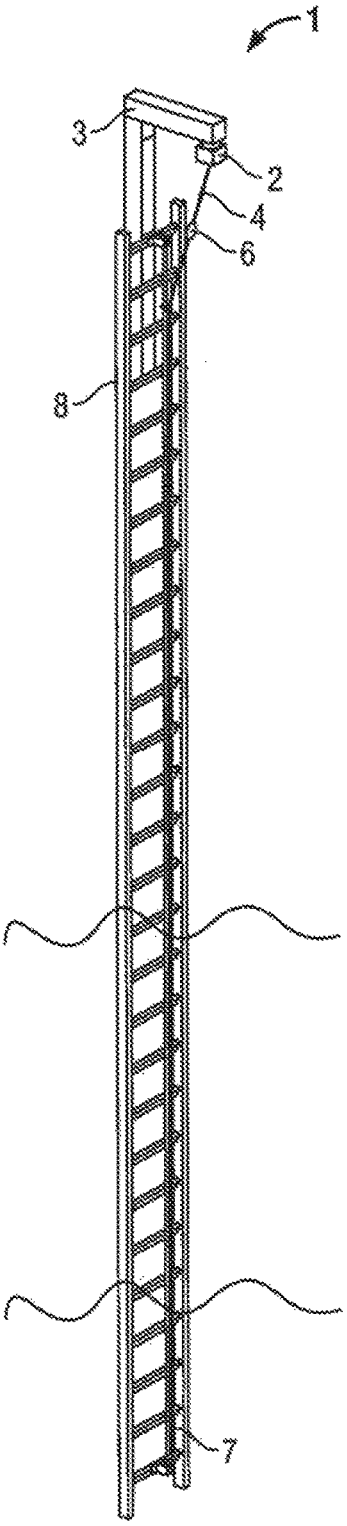
FIG. 1 is a schematic perspective view of a tether line system in accordance with the invention in a home position (safety line fully retracted).
Figure 2:
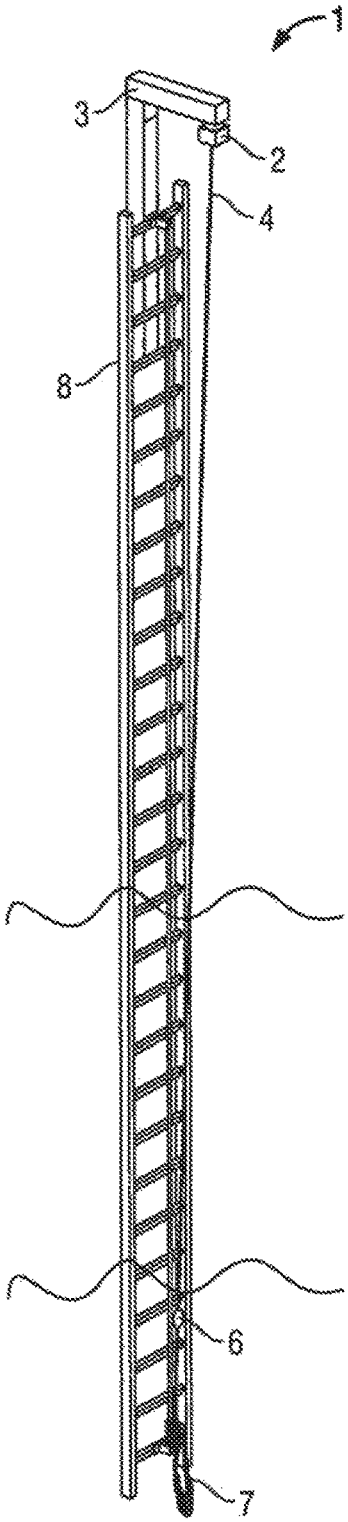
FIG. 2 is a view similar to the view of FIG. 1 but with the tether line in a deployed configuration (safety line fully payed out)
Figure 3:
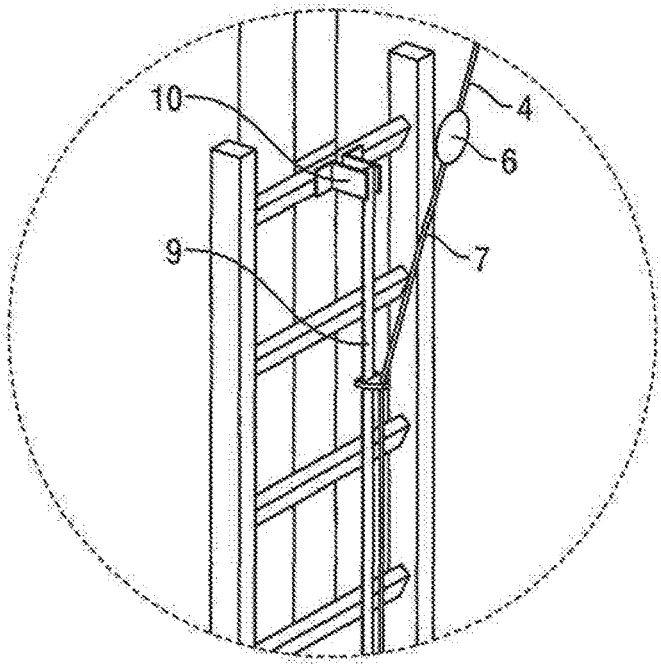
FIG. 3 is a detailed view of a part of the system in the condition of FIG. 1 in a home position (safety line fully retracted)
Figure 4:
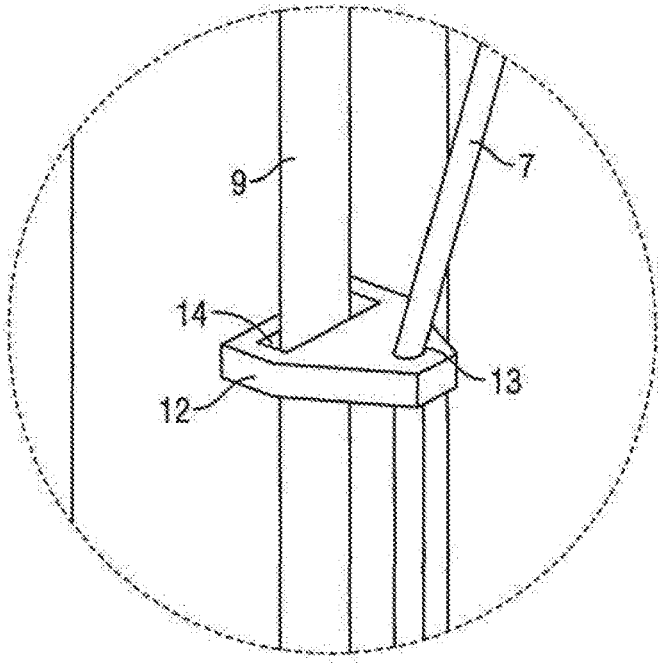
FIG. 4 is a detailed view of a part of the system.

Referring to the drawings there is shown a fall arrest arrangement 1 for use in protection of personnel when ascending and descending relatively high structures, such as towers, masts or the like. The system is particularly suited to use with offshore structures. In FIGS. 1 and 2 the structure to which the fall arrest system is fixed is not shown for purposes of clarity. There is shown an access ladder 8 having a structural support beam 3 mounted at the top.

A self retracting lifeline (SRL) 2 as known in the art is suspended from the beam 3 at the top of the structure and provides a safety line 4 that can be drawn out from a housing of the SRL 2. The safety line 4 is wound on a drum provided internally of the SRL housing. A return spring line retracting device is provided internally of the housing and the SRL 2 includes an energy absorber device in order to absorb energy in the event of a personnel fall situation. These features are known in the art of SRLs. At the free end of the safety line 4 there is provided a Karabiner 6 for attachment to a safety harness worn by the user.

A tether line system is also secured to the structure. The tether line system includes a tether line 7 which is secured at an upper end to the karabiner 6 attached to the safety line 4. The lower end of the tether line is secured at the base of the ladder 8. A guide track comprising tensioned length of webbing 9 is anchored to the ladder 8 at the top and bottom of the ladder by means of a fixing bracket 10, 11, such that the webbing guide track extends substantially the full length of the ladder 8. Typically one of the brackets is provided with means for adjusting the tensioning in the webbing guide track 9. As an alternative to a flexible tensioned guide track a rigid track could be used.

Secured to the tether line 7 at spaced locations along its length are plastic stay clips 12. The stay clips 12 are provided with apertures 13 through which the line passes. The line is secured to the stay clips wither by means of bonding or an interference fit between the tether line and the aperture 13 in the stay clip 12, which is typically sufficient to prevent dislodgement. The plastic stay clips 12 are also provided with a slot 14 through which the webbing guide track 9 is slotted. The slot 14 is dimensioned to permit sliding travel of the stay clip 12 along the webbing guide track 9, whilst preventing parting or separation of the stay clip 12 away from the webbing guide track 9.

Figure 5:
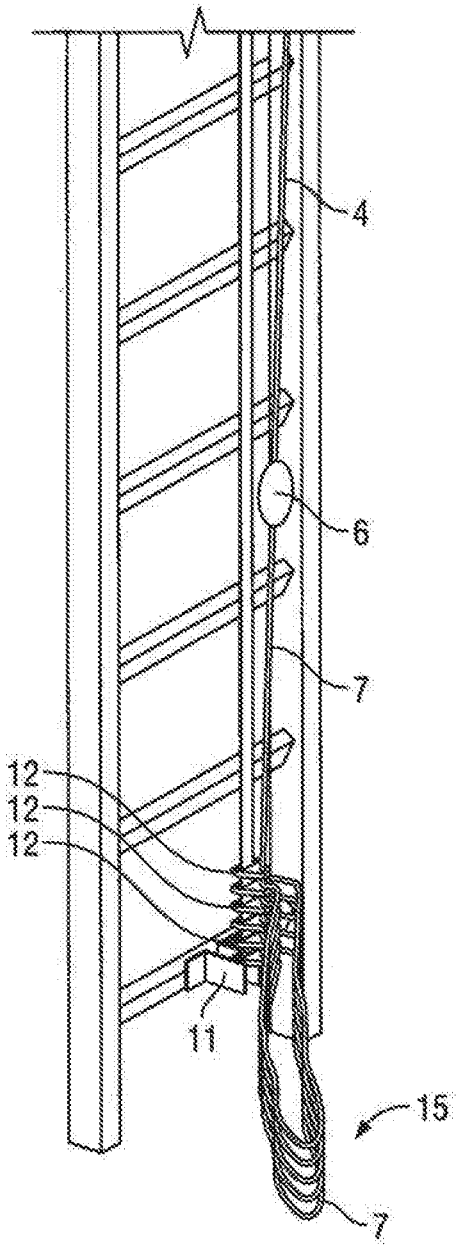
FIG. 5 is a detailed view of a part of the system in the condition of FIG. 2, in which the tether line is in a deployed configuration (safety line fully payed out)

When the arrangement is configured in the home position, as shown in FIG. 1 the safety line 4 is retracted fully in to the SRL 2 and the karabiner is positioned at the uppermost part of the ladder. As shown in FIG. 2, the tether line is connected to the karabiner 6 and the uppermost stay clip is positioned near the uppermost portion of the webbing guide track 9, near the bracket 10. In order to retrieve the safety line from the SRL 2 whilst the user is positioned at the foot of the ladder 8, the user pulls down the tether line 7. As the tether line is increasingly lowered to draw the karabiner 6 and attached safety line 4 downwardly, the successive stay clips 12 collect adjacent with one another on the webbing guide track 9 at the foot of the ladder and the intervening lengths of the tether line 7 form tidy loops 15. This is shown most clearly in FIG. 5. This provides for tether line management in the lifeline deployed configuration. The advantage of this arrangement is that there is controlled gathering of the tether line at the foot of the structure which aids in retraction of the safety line 4 back towards the SRL 2 under the influence of the retraction spring of the SRL. The spring is relatively weak and tangling of the tether line 7 can result in the spring not being sufficient draw the safety line 4 completely back into the SRL 2 housing which can result in damage to the integrity of the SRL and safety in 4 in harsh environments (for example maritime environments). The arrangement provides a 'low friction' solution. The arrangement provides for installation and less maintenance than using the pulley solution, whilst providing advantages over known non-pulley systems.

What is claimed is:

1. A safety line system comprising:

an elongate guide track, wherein a length of the guide track is oriented substantially vertically;

a safety line moveable downward relative to the length of the guide track;

a coupling structure configured to attach a safety harness of a user to the safety line;

a tether line operably coupled to the safety line and moveable downward relative to the length of the guide track to deploy the safety line; and a plurality of stay elements that are secured to the tether line at fixed positions spaced apart from one another along a length of the tether line, wherein the plurality of stay elements are configured to slide parallel to and along the length of the guide track as the tether line moves downward relative to the length of the guide track.

2. The system according to claim 1, wherein the guide track has opposed ends that are secured in corresponding fixed positions by respective mount structures.

3. The system according to claim 1, wherein the guide track is provided with bracket fixing means for mounting the guide track, proximate opposed ends, to a structure with the length of the guide track oriented substantially vertically.

4. The system according to claim 1, wherein the guide track is mounted in tension.

5. The system according to claim 1, wherein the guide track comprises a flexible elongate line.

6. The system according to claim 1, wherein the guide track is a fixed position guide track.

7. The system according to claim 1, wherein the stay elements include a formation arranged to permit sliding travel with respect to the guide track whilst inhibiting parting or separation of the stay elements and the guide track.

8. The system according to claim 1, wherein the stay elements include a channel or slot formation that secures the guide track therein, the channel or slot formation configured to permit sliding travel of the stay elements with respect to the guide track.

9. The system according to claim 1, wherein the stay elements are provided with means for securing to the tether line.

10. The system according to claim 9, wherein the stay elements are provided with holes through which the tether line extends for securing.

11. The system according to claim 1, wherein the guide track is mounted to a ladder structure.

12. The system according to claim 1, wherein the safety line comprises a self-retracting safety line.

13. The system according to claim 1, further comprising:

a ladder fixed to a structure; and a self-retracting safety line device mounted above the ladder, wherein the self-retracting safety line device includes the safety line;

wherein the guide track extends along at least a lengthwise part of the ladder.

14. The system according to claim 5, wherein the flexible elongate line comprises a length of webbing, or a length of ribbon or a length of rope.

15. The system according to claim 1, wherein the tether line is configured to be pulled downward in order to deploy the safety line.

* * * * *